US005318171A

United States Patent [19]

Szekely

[11] Patent Number: 5,318,171

[45] Date of Patent: Jun. 7, 1994

[54] WATER COLOR PAINTING APPARATUS

[76] Inventor: Laszlo Szekely, Bergalidsvagen 3, S-632 Eskilstuna, Sweden

[21] Appl. No.: 3,251

[22] Filed: Jan. 11, 1993

[51] Int. Cl.[5] ..... B05C 17/00; B44D 3/00

[52] U.S. Cl. ..... 206/1.7; 206/1.8; 206/362

[58] Field of Search ..... 206/1.7, 1.8, 1.9, 361, 206/362, 209

[56] References Cited

U.S. PATENT DOCUMENTS

| | | | |
|---|---|---|---|
| D. 232,703 | 9/1974 | Konzi | D9/227 |
| D. 257,109 | 9/1980 | Conti | D7/38 |
| D. 264,096 | 4/1982 | Jones | D19/35 |
| D. 270,225 | 8/1983 | Chiulli | D9/341 |
| 3,105,263 | 10/1963 | Ginter | 206/361 X |
| 3,215,263 | 11/1965 | Mathison | 206/361 |
| 3,786,913 | 1/1974 | Crawford | 206/1.8 |

FOREIGN PATENT DOCUMENTS

| | | | |
|---|---|---|---|
| 713570 | 8/1954 | United Kingdom | 206/1.9 |

*Primary Examiner*—William I. Price

*Attorney, Agent, or Firm*—Andrus, Sceales, Starke & Sawall

[57] ABSTRACT

A water color painting kit apparatus includes a color stand having a plurality of recesses with water color blocks secured in each recess. The blocks project upwardly from the outer surfaces in coplanar orientation. Three paint brushes are included, each having a stiff blade covered with a thin water absorbing sponge, including a lower rounded painting edge. One brush has a length to cover three immediately adjacent blocks, another brush covers two blocks and a third brush covers one block. A water tray has a water chamber with a water absorbing foam pad in the chamber. The top portion of the pad is above the water line in the chamber. The pad absorbs the water and creates a top-wall of predetermined moisture content. The blade engages the pad to moisturize the cover for controlled take up of the water color from the color block(s) for painting of an article.

18 Claims, 3 Drawing Sheets

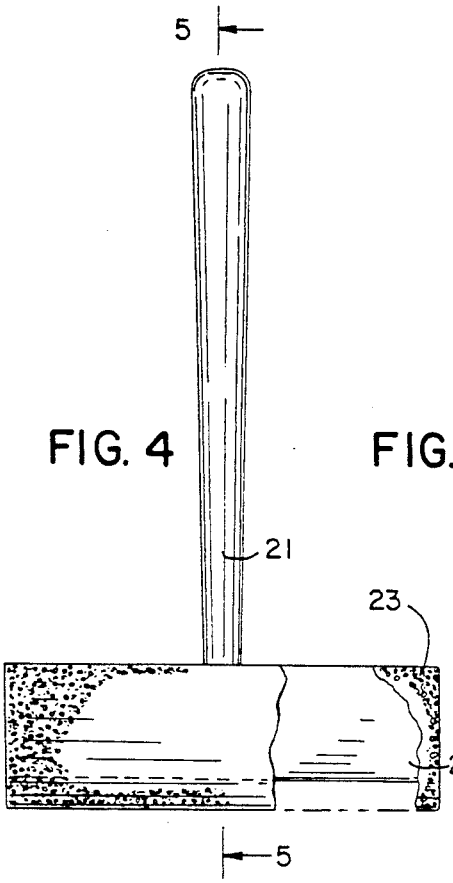
FIG. 4
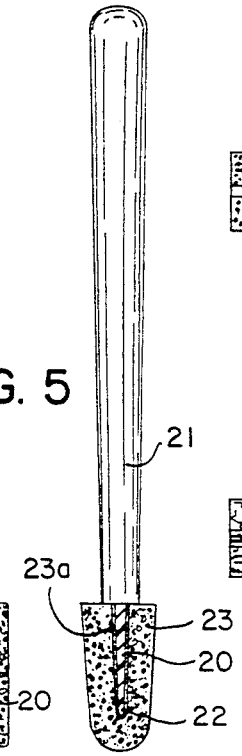
FIG. 5
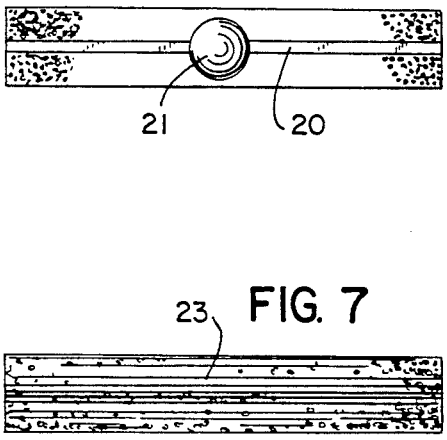
FIG. 6
FIG. 7
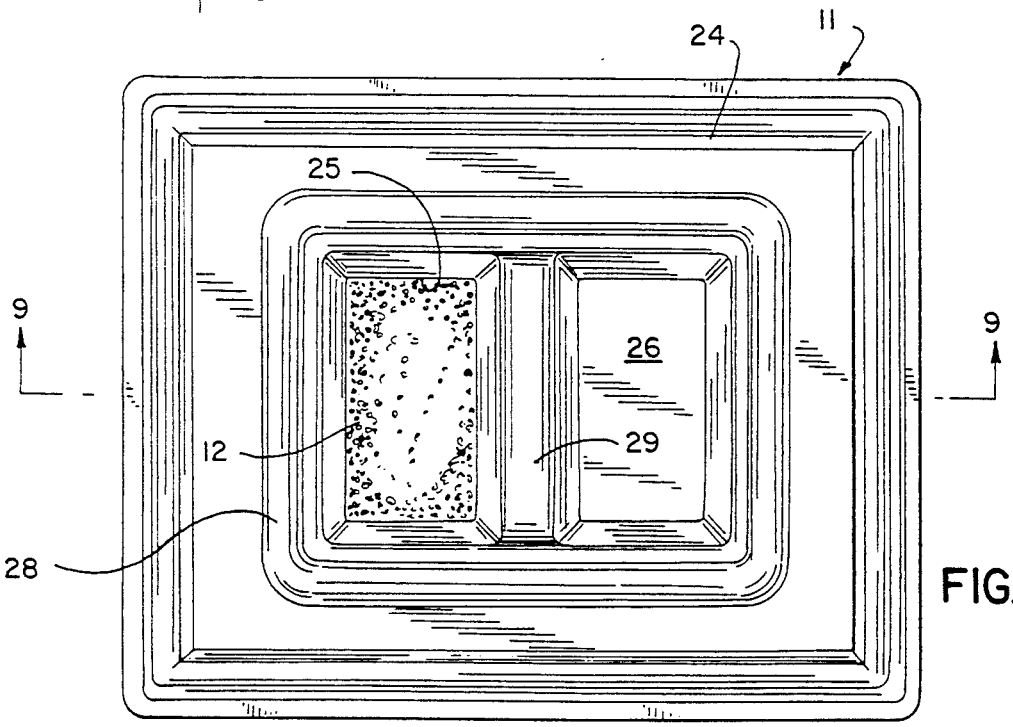
FIG. 8

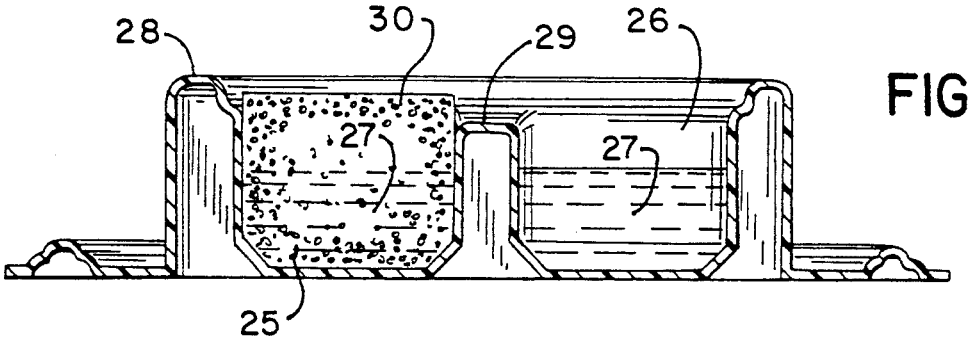
FIG. 9
FIG. 10
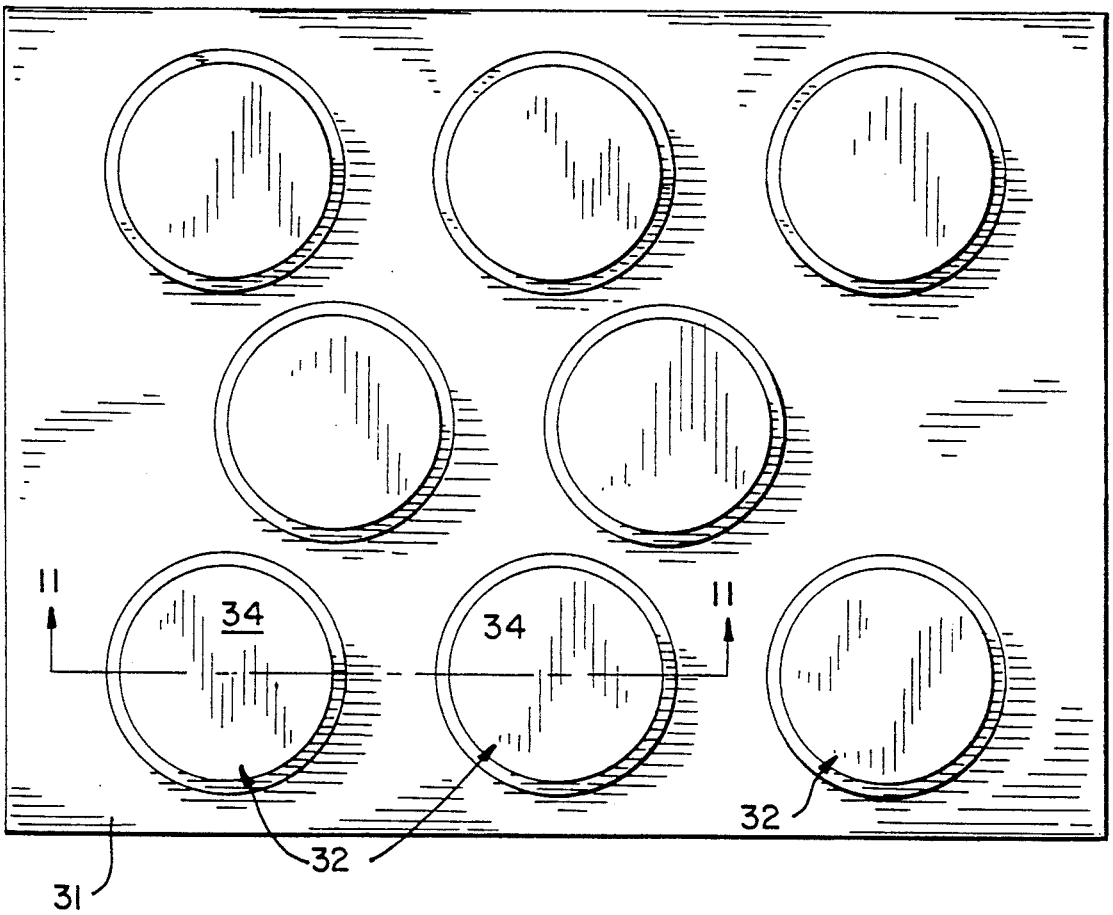
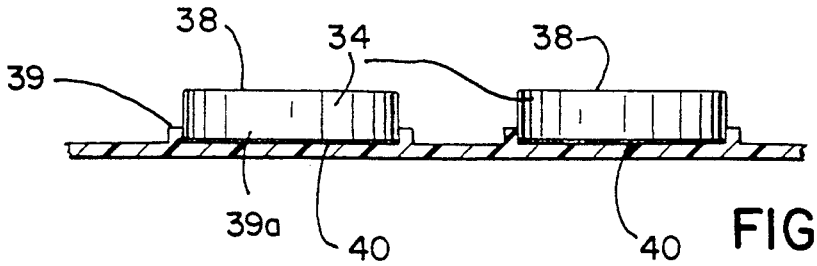
FIG. 11

WATER COLOR PAINTING APPARATUS

BACKGROUND OF THE INVENTION

The present invention relates to water color painting apparatus and to the method of painting therewith.

Painting with water colors is of significant interest to individuals of widely varying ages. Children as young as three years of age enjoy painting with water colors and the like. Such painting by children from kindergarten and upwardly can be significantly educational in developing a sense of color and art works. It is also of extreme suitability and interest for the enjoyment and development of handicapped individuals. With respect to handicapped persons, paintings can provide stimulation and therapeutic effects. Water color painting of pictures and the like is, of course, of interest to adults as well as children. In addition, painting of motif for textile industry, plaque art and vertical tapestry and other similar products is also of substantial significance.

Generally, the artist painting with water colors and the like therefor has involved the use of relatively small paint brushes having bristle ends. The water colors are provided in separate small containers which surround the color and contain water applied in picking upon the color with the brush. The user dips the brush into a water-bath, then onto a watercolor supply block within a confining container and finally applies the brush to the paper. Such action often results in extreme difficulty, particularly for young and inexperienced painters, in controlling color separation and application. Children also normally use the brush directly from one color unit to another and excess water in the brush leaves excess water behind on the color unit. Further, the water content in the color as applied to paper or other articles will vary and is often excessive.

Often in water color painting, it is desirable to use coordinated colors. With significant knowledge, coordinated coloring is readily supplied. Such techniques and abilities are difficult for children and other parties, particularly when beginning to develop an interest in painting. The technique is particularly difficult to apply in the conventional water color painting with bristle type brushes and the like.

There is therefore a need for a water color painting apparatus with improved and simplified painting procedures.

SUMMARY OF THE PRESENT INVENTION

The present invention is particularly directed to a special painting apparatus particularly constructed for coordinated water color painting which is adapted for use by both young children, as young as three years and older, as well as adults with varying knowledge and ability in painting. Generally, in accordance with the teaching of this invention, the water colors are provided in closely spaced solid block-like members with exposed surfaces in a substantially common planer orientation and in outwardly spaced relation to a support structure such as a color stand in combination with special broad absorbent sponge-like paint brushes having an inner rigid supporting element and an outer water and color absorbing surface. The color blocks are arranged in side-by-side relationship and preferably in a particular color coordinated orientation. The broad brushes include brush heads having a width adapted to span two or more color blocks and thereby allowing simultaneous take-up of two or more colors on the sponge members in proper distinct adjacent relation. The head of the broad brushes are specially constructed with a thin outer liquid absorbing surface of a limited thickness affixed to a rigid support member. A water supply unit includes a sponge-like element or the like having an outer surface presenting a controlled water supply for controlled transfer of water into the relatively thin sponge-like surfaces of the brush. The water supply unit establishes a controlled proper wetting of the brush sponge. This provides for a controlled transfer of liquid to the brush which provides a more optimal absorption of the colors from the color block for transfer to and advantageous application of the colors to the article which one is painting.

Thus, the combination of the soft and thin surface of the brush, the fixed mounting of the color blocks and the controlled water supply provide a multi-colored painting system and apparatus for applying one or a plurality of adjacent separate colors with individual single brush strokes and requiring minimal experience or technical skill.

More particularly, in one embodiment of the present invention, a plurality of the sponge brushes are provided having similar heads but of different lengths. Each of the heads include a rigid elongated stabilizing head member to which a simple handle is attached. A relatively thin soft foam plastic which has the ability of absorbing water in limited degrees covers the head member. A separate support structure is provided with individual color blocks of water color materials affixed to the support structure. The blocks project upwardly from the uppermost plane of the support to expose the surfaces of the blocks in a substantially common relationship. The spacing of the blocks is such that the thinnest brush absorbs a single color while two or more of the additional brushes each span a different plurality of the blocks to absorb a plurality of colors without significant mixing of said colors. In practice, one brush may be provided to span two adjacent blocks while a third brush spans three adjacent color blocks.

By applying the painting end or tip of the brush, after moisturizing the cover, to the color block or blocks and then to the surface, a relatively narrow line of adjacent colors is generated, with the width of the line partially controlled by depressing of the brush. Broader widths can, of course, be generated by tipping of the brush, thereby increasing the area of the painting edge impressed on the article.

In other embodiments, the orientation of the blocks can be varied, but in such orientation as to maintain the outer surfaces substantially in coplanar relation. In one embodiment, the blocks are mounted on edge with the lower portion secured within a suitable recess within a stand with the greater portion of the blocks projecting upwardly. In an alternate orientation, the color blocks are mounted with the faces secured to the support and with the blocks projecting upwardly therefrom in appropriately spaced orientation to expose an outer face of each block for receiving of the paint brush.

A tray structure may be conveniently provided having one or more water chambers, each of which is provided with a sponge member for absorbing water and providing an upper surface for controlled water transfer to the absorbing cover of the brushes.

The present invention provides a particularly simple, reliable and effective painting apparatus consisting of the specially mounted color block in combination with the water absorbent covered brushes and a controlled water supply for wetting of the covered brushes for developing multi-colored painting with water colors.

BRIEF DESCRIPTION OF THE DRAWINGS

The drawings provided herewith illustrate the best mode presently contemplated for carrying out the invention and are fully described hereinafter.

In the drawings:

FIG. 4 is an enlarged view of a paint brush shown in FIG. 1, with parts broken away and section;

FIG. 5 is a vertical section taken generally on line 5—5 of FIG. 4;

FIG. 6 is a top view of FIG. 4;

FIG. 7 is a bottom view of FIG. 4;

FIG. 8 is a top view of a water supply unit;

FIG. 9 is a vertical sectional view of a water supply unit shown in FIG. 8, with paint brushes shown in overlaying relationship for purposes of illustration, in accordance with one embodiment of the present invention;

FIG. 10 is an elevational top view of an alternate embodiment of a color stand illustrating a different orientation of the color blocks; and FIG. 11 is a cross-sectional fragmentary view of the color stand shown in FIG. 10 and taken generally on line 11—11 of FIG. 10, with a brush unit located in overlying relationship to a plurality of the color blocks shown in FIG. 10.

DESCRIPTION OF THE ILLUSTRATED EMBODIMENT

Figure 1:
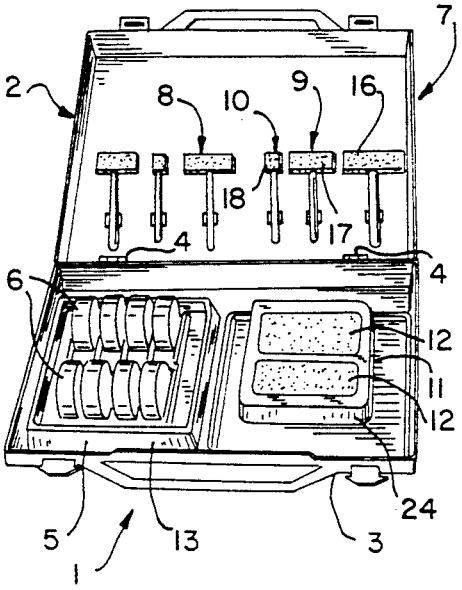
FIG. 1 is a pictorial view of a painting apparatus incorporating the teaching of the present invention.

Referring to the drawings and particularly to FIG. 1, a painting apparatus in kit form is illustrated. The apparatus includes an outer casing 1 shown as a folding case unit having an upper top cover 2 and a bottom case 3 which are hinged to each other as at 4 for enclosure of the various components for painting in accordance with the illustrated embodiment of the invention. The casing may be formed of a molded plastic construction with suitable hinges and clasps for opening and closing of the case unit.

In accordance with the illustrated embodiment of the invention, a multiple color supply unit 5 is provided incorporating a plurality of different water color blocks 6. A multiple brush assembly or unit 7 including a plurality of different sized blade-like brushes 8, 9 and 10 is provided. Each brush is of substantially the same construction and differs only in the length of the painting edge. In addition, a water supply unit 11 is provided, which in the illustrated embodiment of the invention includes two separate water supply control elements 12. Generally, each brush 8, 9 and 10 is adapted to be applied to an element 12 of the water control unit 11 to receive a controlled amount of water. The brush is then applied to the color blocks 6 to absorb the water color paint material from one or more of the aligned blocks which are engaged across the length of the brush. The brush is then applied directly to an article, not shown, such as a piece of coloring paper, tapestry cloth or other article.

Figure 2:
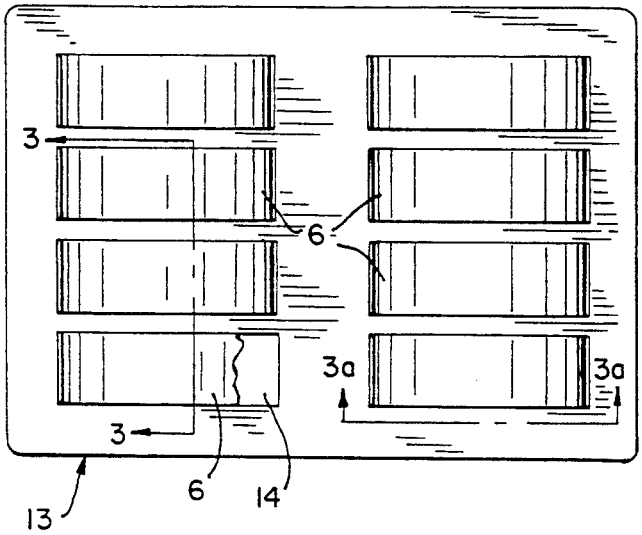
FIG. 2 is an enlarged top view of a color block unit shown in FIG. 1.
Figure 3:
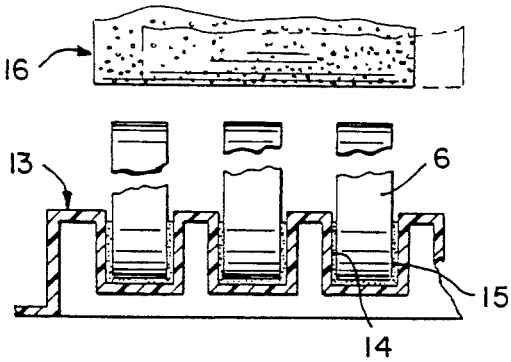
FIG. 3 is a fragmentary vertical section taken generally on line 3—3 of FIG. 2.
Figure 3A:
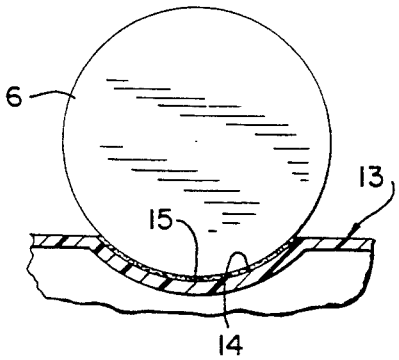
FIG. 3*a* is a fragmentary vertical section taken generally on line 3*a*—3*a* of FIG. 2.

More particularly and as shown more clearly in the FIGS. 1–3, each of the color blocks 6 is a solid mass of water color material and are particularly shown as identical cylindrical and round blocks of different shades of colors. Basically, a red, blue, yellow, green, red, purple, and other shades are provided. The particular colors are preferably coordinated in accordance with well known color technologies. The colors selected may, of course, be of any desired colors. The colors are preferably selected with adjacent colors coordinated, and for children particularly include relatively bright colors to attract and maintain the interest of the children. The individual blocks 6 are secured to a base support or stand 13.

In the illustrated embodiment, the support stand 13, which may be a plastic formed member, is provided having an upper wall including a plurality of closely spaced concave recesses or openings 14, one for each block 6. Each block is located with the peripheral edge disposed within a recess 14 and projects therefrom. The block 6 is secured within the recess 14 as by a suitable securement element 15 to firmly support the block in location within the stand.

The securement element 15 preferably releasably secures the block to allow replacing of the blocks 6. Thus, the blocks may be secured with a suitable adhesive, an adhesive tape element as shown or other suitable element.

The blocks 6 are laterally spaced from each other by a distance slightly less than the width of the blocks. The spacing of the color blocks 6 and the brush construction are interrelated to each other, as follows.

The three brushes 8, 9 and 10 are illustrated as a part of the brush unit 7. A first brush 8 has a relatively long head 16. The second brush 9 has an intermediate length head 17 and the third brush 10 has a single narrow length head 18.

As shown most clearly in FIG. 3, the head 16 spans three of the color blocks 6. The head 17 spans essentially two of the color block. Head 18 is adapted to be aligned to a single color block 6. The orientation of the blocks 6 as shown, is such that lateral displacement of the brushes from the above alignment establishes further partial overlapping with an adjacent color block 6. Thus, the long brush head 16 of brush 6 is shown in phantom in FIG. 3 shifted slightly such that the inner edge of the first and fourth blocks 6 are partially aligned with the outer edges of the brush head.

The numbers of brushes and the precise length of each brush is not critical, but preferably is constructed in a preferred practical implementation in accordance with the illustration, as shown in FIGS. 1 and 3.

Each of the illustrated brush heads is similarly constructed and reference is made to the long head in accordance with the illustration, as shown in FIGS. 1 and 3.

Each of the illustrated brush heads is similarly constructed and reference is made to the long head 16 as more clearly shown in FIGS. 4–7 for purpose of description and discussion. The head 16 includes a relatively rigid elongated blade 20. A spindle or rod-like handle 21 is secured to the center of the outer edge of blade 20 and projects outwardly therefrom. In a typical structure, the width of the blade 20 is 8 cm, the depth is $2\frac{1}{2}$ cm and the handle is 11 cm. Any other sizes may of course be provided, which may vary with the age, skill level or the like. The blade 20 and the handle 21 may, for example, be conveniently formed of a suitable molded plastic.

As shown in FIG. 5, the blade 20 preferably has a slightly tapered cross-section extending downwardly from the handle 21 to a relatively thin, rounded outer painting edge 22. The painting edge 22 and sides of the blade is covered by a relatively thin water absorbent layer or cover 23 of a water absorbing material. In a practical implementation, a sponge plastic material, such as a soft polyurethane, having a thickness of about ½ cm has been found to provide a highly satisfactory result. The thickness may vary with the particular material used and with any given material the thickness is not a single value. The thicknesses should be selected to moisten the brush end sufficient to pick-up the color material without excessive fluid left on the color blocks or applied to the article. This can be easily set by testing the moisture application. The cover 23 is shown adhesively bonded to the edge and sides of the blade as at 23*a*. Although the precise thickness of the cover is not critical, the thickness of the cover is selected to absorb the color material from blocks 6 without leaving excess water on the blocks, or the articles to which the color is applied.

The water supply unit 11, as more clearly illustrated in FIGS. 1, 8 and 9, includes a two chamber tray 24 which is conveniently formed of a suitable molded plastic, with elements 12 located in separate chambers 25 and 26. Elements 12 are water absorbent blocks formed preferably of the same plastic sponge material as the covers 23. The two chambers 25 and 26 are identically constructed and reference is made to chamber 25 for purposes of discussion. Chamber 25 is filled with sufficient water 27 to saturate the lower portion of sponge block 12.

The top wall or surface of the block 12 is located at the upper surface of the chamber 25 and particularly above the level of water 27. In the illustrated embodiment of the invention, the tray 24 has an outer encircling lip 28 located in a common plane and an intermediate dividing wall 29 spaced slightly downwardly of the lip to define the two side-by-side chambers 25 and 26.

Each chamber is shown rectangular in configuration and the sponge block 12 has a similar rectangular configuration. The sponge block is of a slightly greater length and width and is pressed downwardly into the chamber and held therein as a result of the slight compression of the block.

The depth of the sponge block 12 is slightly greater than the depth of the chamber. The raised portion 30 absorbs water but is above the water level 27 and is not thoroughly saturated with water. The upper portion 30 is also exposed for engagement by the painting edge portion of the brushes, and the length of each chamber and sponge is preferably greater than the longest head 16.

With the chambers containing sufficient water 27 to maintain the upper surface portion 29 moist, the painter presses brush 8, 9, or 10 and particularly the painting edge 22 to the upper surface to obtain a controlled amount of water to properly moisten the brush. The controlled supply of water and the controlled moisturizing of the brush cover 23 regulates and optimize the water taken up by the brush from the water supply unit. The moist brush is then applied to one or more blocks resulting in appropriate absorption of the water color into the brush cover 23.

In summary, the combination of the water absorbent covered brush structure, the supported solid color blocks and the water regulating supply provides a highly effective multi-color painting system with each length single brush stroke providing multiple or single color application in a water color painting of an article.

A second embodiment of the invention is illustrated in FIGS. 10 and 11.

A small casing, not shown, has a generally rectangular box base 31. The second embodiment includes a brush set similar to that shown in FIGS. 1 and 4–7 inclusive, and is not further illustrated. A color block set 32 is secured to base 31 and a separate water control element, not shown, generally as in the first embodiment, is also provided.

Color set 32 includes a plurality of similar color blocks 34 which are secured to the bottom wall of the base 31. In the second embodiment, the color blocks are of a lesser diameter and thickness than in the first embodiment. Each color block 34 is secured within the base member and with the plane surface or face 38, rather than the edge, exposed. The block 34 is mounted within a cylindrical upstanding wall 39 defining a chamber 39*a*. An adhesive 40 secures the block within the recessed chamber 39*a* with the top portion of the block projecting upwardly above the upper edge of the chamber wall. The upper face 38 of each color block 34 is thus clearly exposed, and with faces 38 in a substantially common plane. The blocks 34 are spaced from each other in accordance with the size of brushes. In the second embodiment, the longest brush such as brush 8 and head 16 does not span three colors but rather has a coverage of two colors when aligned therewith. The brushes can be shifted to cover the central portion of one color and the outer edges of two adjacent colors.

The organization and size of the blocks can be varied widely within the teaching of the present invention, but are constructed for single and multiple brush engagement, with different sized brushes for single and multiple color application.

In the second embodiment, a separate water container is not provided. Rather, individual control elements such as thin pads are provided which can be put into a separate water container provided directly by the user. In this instance, the pads are relatively larger rectangular pads but of a lesser depth than elements 12 of the first embodiment. Again, as used by children or by adults, the water supply provides a controlled transfer manner by an adult to permit the effective coloring, as used by younger children and the like.

Thus, in using this system, water is applied within an appropriate container with the control element absorbing the water and providing a top portion above the water level to provide a controlled water supply.

As in the first embodiment, the brush is selected of an appropriate length to cover a selected portion of the drawing. The covered blade is pressed onto the water supply sponge and then applied to the color blocks, engaging a single block or spanning the appropriate color block(s) and then pressed onto the article to apply the paint from the outer painting edge 22 to the article.

A basic drawing may be drawn and outlined with straight lines, semicircles, and circles. The drawing can be drawn with continuous lines, short spaced lines, wavy lines and the like by manipulating of the brushes.

As used in the present application, the definition of the color source as a block includes all substantially self-supporting elements which have similar portions for attachment to a support and with exposed surfaces for common orientation to permit take-up by a plurality of special brushes having the water controlled surface elements.

The various elements of the invention comprising the covered brushes, the supported exposed color blocks and the water control unit may be of various construction within the teaching of the present invention. The color may be any suitable shape and releasably or fixedly secured to a reusable or throw away support. Similarly, the water control supply may be provided with or without a support structure and even provided by instruction where the element is readily available at retail stores and the like.

Various modes of carrying out the invention are contemplated as being within the scope of the following claims particularly pointing out and distinctly claiming the subject matter which is regarded as the invention.

I claim:

1. A water color painting apparatus for painting the surface of an article comprising a plurality of color blocks each of a different color, each of said color blocks being of the same construction, a support structure, attachment elements connecting said color blocks to said support structure in side-by-side spaced relation and with said color blocks projecting therefrom and with an upper surface supported in substantially outwardly spaced relation to said support structure and locating said upper surfaces of said color blocks in a spaced aligned relation, at least one brush member having a head adapted to span a plurality of said adjacent color blocks, said head including an inner stabilizing element of a substantially rigid construction and having an outer application edge, said stabilizing element having a handle portion, and an outer cover of a water absorbing material covering said stabilizing element including said outer application edge and adjacent portions of said element, said brush being operable upon moisturizing of said cover to span said color blocks and absorb the colors from said outer surfaces for simultaneous transfer of the colors to the article without transfer of color from one block to an adjacent block and whereby liquid transferred from said brush onto said block flows downwardly over the block to prevent transfer of color material between the upper surfaces of said color blocks.

2. The apparatus of claim 1, including a water supply unit consisting of at least one water chamber adapted to contain a water supply, a water absorbing member in said chamber with an upper surface above said water supply and presenting an upper surface for engagement by said brush member, said upper surface co-acting with said cover to control the moisturizing of said cover and thereby adapting said brush for effective absorption of color material from said color blocks for establishing application of the color material from said brush member to the article without excessive liquidity of said color blocks.

3. The apparatus of claims 1 or 2, wherein said support structure and said attachment elements engage a similar portion of each color block such that substantially all said color blocks project outwardly from the support in the same orientation with co-planar aligned outer surfaces whereby essentially all of the color material is available for absorption onto said brush member.

4. A water color painting apparatus for painting the surface of an article comprising a plurality of color blocks each of a different color, each of said color blocks being of the same construction, a support structure, attachment elements connecting said color blocks to said support structure in side-by-side spaced relation and with said color blocks projecting therefrom and with an upper surface supported in substantially outwardly spaced relation to said support structure and locating said upper surfaces of said color blocks in a spaced aligned relation, at least one brush member having a head adapted to span a plurality of said adjacent color blocks, said head including an inner stabilizing element of a substantially rigid construction and having an outer application edge, said stabilizing element having a handle portion, and an outer cover of a water absorbing material covering said stabilizing element including said outer application edge and adjacent portions of said element, said brush being operable upon moisturizing of said cover to span said color blocks and absorb the colors from said outer surfaces for simultaneous transfer of the colors to the article without transfer of color from one block to an adjacent block and whereby liquid transferred from said brush onto said block flows downwardly over the block to prevent transfer of color material between the upper surfaces of said color blocks, wherein said color blocks are mounted on said support structure on edge and extend upwardly therefrom a substantial multiple of the thickness of the color blocks.

5. The apparatus of claim 4, wherein said support structure is a plastic member having a plurality of side-by-side recesses, said blocks having an edge located within a recess.

6. The apparatus of claim 5, including an adhesive securing the block in the recess.

7. The apparatus of claim 4, wherein said stabilizing element includes a rigid plate of a length of the head, said plate having a lower rounded edge defining said painting edge, said water absorbent cover including a plastic foam affixed to said plate including the edge and the adjacent portion of said plate.

8. The apparatus of claim 7, wherein said cover has a thickness on the order of ½ centimeters.

9. The apparatus of claim 7, wherein said brush plate is a plastic member having a tapered cross section expanding outwardly slightly from said rounded edge, said plate having a maximum thickness at the outer edge on the order of two millimeters and the bottom edge on the order of one millimeter.

10. The apparatus of claim 3, wherein at least one brush member spans in excess of two of said color blocks.

11. The apparatus of a claim 10, wherein at least a second brush member has a blade of a length equal to the individual adjacent color blocks.

12. The apparatus of claims 1 or 2, including a second brush member of a length to span two of said color blocks and a third brush of a length to span one of said color blocks.

13. A painting kit assembly for water color painting of an article comprising a color stand having a plurality of recesses, a plurality of water color blocks secured one within each of said recesses and projecting upwardly therefrom with the outer surfaces of said blocks located substantially spaced from said color stand and in substantially co-planar orientation, each said block being formed as a substantially continuing color material whereby said color block provides a color supply located substantially above said color stand, a plurality of paint brushes each including a stiff plate-like blade having an elongated application edge, said brushes having different length application edges, each said brush having a handle projecting outwardly from said blade, said application edge of said blade having a rounded edge, a water absorbing cover of a thin and resilient material secured overlying said rounded edge and the sidewalls of said stiff plate-like blade, a water container having an inner chamber adapted to contain a water supply, a water absorbing resilient material located within said chamber and projecting upwardly from the chamber, said resilient material absorbing water and presenting a top surface of a predetermined moisture content, said covered blade edge upon engaging said upper surface absorbing an appropriate amount of water into said cover to moisturize said cover for absorbing water color from said top face of said color blocks for clear and accurate transfer of color to said article and without transfer of color material from one block to another as a result of water transfer from a block to said stand.

14. A water color painting apparatus for painting an article, comprising a plurality of color blocks of different colors, a support structure, means attaching said color blocks to said support structure in side-by-side spaced relation, a plurality of painting brushes, and at least one brush member having an end head adapted to span a plurality of adjacent color blocks, each of said brushes including an inner stabilizing member of a relatively rigid structure and having an elongated painting edge, a handle secured to said stabilizing member, an outer thin cover of a water absorbing material covering said stabilizing member is a rigid blade including a rounded edge as said painting edge, said cover extending over said painting edge and the adjacent side of said blade, said blade having a significantly greater length than the exposed surface of each of said color blocks and operable upon moisturizing of said cover to span said color blacks and absorb the several colors for transfer to the article.

15. A water color paint supply for painting with rigid sponge covered brushes having an outer cover for absorption of water, comprising a support stand, a plurality of color blocks of a water color paint, said support stand including individual color block supports located in close spaced relation, said color blocks secured one each to said supports and securing the color blocks to said stand, said color blocks projecting substantially outwardly from the stand and having substantially exposed portions located in co-planar orientation whereby substantially all of the color material is available above said supports for absorption onto a sponge covered rigid brush and without accumulation of water on the color blocks.

16. A water color paint support for painting with rigid sponge covered brushes, comprising a stand, a plurality of color blocks of a water color paint, attachment means engaging a portion of each color block and said stand to secure the color blocks to said stand, said color blocks projecting outwardly from the stand and having exposed portions located in co-planar orientation whereby substantially all of the color material is available for absorption onto a sponge covered rigid brush, wherein said color blocks are mounted on said support structure on edge and extend upwardly therefrom a substantial multiple of the thickness of the color blocks.

17. The apparatus of claim 15, wherein said stand is a plastic member including a base wall having an outer encircling wall, said block supports including a raised wall portion within said encircling wall and a plurality of side-by-side recesses within said raised wall portion, said blocks having an edge located one each within a separate recess and projecting substantially upwardly from said recess.

18. The apparatus of claim 17, including an adhesive securing the block in the recess.

* * * * *